US006287737B1

(12) United States Patent
Ong et al.

(10) Patent No.: US 6,287,737 B1
(45) Date of Patent: Sep. 11, 2001

(54) PHOTOCONDUCTIVE IMAGING MEMBERS

(75) Inventors: Beng S. Ong; Ping Liu; Cheng-Kuo Hsiao, all of Mississauga (CA); Huoy-Jen Yuh, Pittsford, NY (US); John S. Chambers, Rochester, NY (US); Damodar M. Pai; Markus R. Silvestri, both of Fairport, NY (US); Kathleen M. Carmichael, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/579,491

(22) Filed: May 30, 2000

(51) Int. Cl.[7] ..... G03G 5/047; G03G 5/14

(52) U.S. Cl. ..... 430/58.8; 430/58.65; 430/59.4; 430/64

(58) Field of Search ..... 430/64, 96, 58.8, 430/58.65, 59.4

(56) References Cited

U.S. PATENT DOCUMENTS

| | | | | |
|---|---|---|---|---|
| 4,265,990 | | 5/1981 | Stolka et al. | 430/59 |
| 5,473,064 | | 12/1995 | Mayo et al. | 540/141 |
| 5,482,811 | | 1/1996 | Keoshkerian et al. | 430/135 |
| 5,493,016 | | 2/1996 | Burt et al. | 540/139 |
| 5,645,965 | | 7/1997 | Duff et al. | 430/59 |
| 5,871,877 | | 2/1999 | Ong et al. | 430/59 |
| 5,874,193 | | 2/1999 | Liu et al. | 430/59 |
| 6,030,735 | * | 2/2000 | Springett | 430/64 |

* cited by examiner

*Primary Examiner*—John Goodrow
(74) *Attorney, Agent, or Firm*—E. O. Palazzo

(57) ABSTRACT

A photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water (I)

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

53 Claims, No Drawings

PHOTOCONDUCTIVE IMAGING MEMBERS

RELATED PATENTS

Disclosed in U.S. Pat. No. 5,645,965, the disclosure of which is totally incorporated herein by reference, are photoconductive imaging members with perylenes and a number of charge transports, such as amines.

Disclosed in U.S. Pat. No. 5,874,193, the disclosure of which is totally incorporated herein by reference, are photoconductive imaging members, with a hole blocking layer comprised of a crosslinked polymer derived from crosslinking a alkoxysilyl-functionalized polymer bearing an electron transporting moiety. In U.S. Pat. No. 5,871,877, the disclosure of which is totally incorporated herein by reference, are illustrated multilayered imaging members with a solvent resistant hole blocking layer comprised of a crosslinked electron transport polymer derived from crosslinking a thermally crosslinkable alkoxysilyl, acyloxysilyl or halosilyl-functionalized electron transport polymer with an alkoxysilyl, acyloxysilyl or halosilyl compound, such as alkyltrialkoxysilane, alkyltrihalosilane, alkylacyloxysilane, aminoalkyltrialkoxysilane, and the like; illustrated in U.S. Pat. No. 5,482,811, the disclosure of which is totally incorporated herein by reference, are imaging members with photogenerating pigments of, for example, Type V hydroxygallium phthalocyanine. Advantages of the imaging members of the present invention with respect to U.S. Pat. No. 5,871,877 include, for example, a more rapid crosslinking rate, for example, in embodiments less than about one minute, and water can be added to accelerate the crosslinking reaction. Decreased crosslinking or curing times of, for example, 1 minute is particularly important for web-coating of photoreceptor belts as the coating operation is continuous and usually does not tolerate undue delay in the fabrication of the blocking layer. The hole blocking layer of the present invention also enables the resulting photoreceptor to exhibit excellent electrical properties such as high low residual potential voltage and stable cyclic characteristics in various environmental conditions.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a perylene photogenerating layer, which is preferably a mixture of bisbenzimidazo(2,1-a-1',2'-b)anthra(2,1,9-def:6,5,10-d'e'f')diisoquino-line-6,11-dione and bisbenzimidazo(2,1-a:2',1'-a)anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Also, illustrated in U.S. Pat. No. 5,645,965, the disclosure of which is totally incorporated herein by reference, are symmetrical perylene photoconductive members.

The appropriate components and processes of the above patents may be selected for the present invention in embodiments thereof.

BACKGROUND OF THE INVENTION

This invention is generally directed to imaging members, and more specifically, the present invention is directed to multilayered photoconductive imaging members with a hole blocking layer comprised of a crosslinked polysiloxane derived from crosslinking a trialkoxysilyl-functionalized hydroxyalkyl acrylate or trialkoxysilyl-functionalized hydroxyalkyl acrylate with an aminoalkylalkoxysilane, such as gammaaminoalkyltrialkyloxysilane, and wherein the presence of a hydroxyalkyl moiety enables the addition of water to the coating solution without substantially causing phase separation, and wherein the curing or crosslinking of the hole blocking layer can be accelerated. The hole blocking layer is preferably in contact with a supporting substrate and is preferably situated between the supporting substrate and the photogenerating layer preferably comprised of the photogenerating pigments of U.S. Pat. No. 5,482,811, the disclosure of which is totally incorporated herein by reference, especially Type V hydroxygallium phthalocyanine. The imaging members of the present invention in embodiments exhibit excellent cyclic/environmental stability, and substantially no adverse changes in their performance over extended time periods, and also the imaging members can comprise a solvent resistant hole blocking layer enabling the coating of a subsequent photogenerating layer thereon without structural damages, and which blocking layer can be easily coated on the supporting substrate by various coating techniques of such as, for example, dip or slot-coating. The aforementioned photoresponsive, or photoconductive imaging members can be negatively charged when the photogenerating layer is situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are preferably useful in color xerographic applications.

PRIOR ART

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder, as a hole transport layer. The above components, such as the photogenerating compounds, and the aryl amine charge transport can be selected for the imaging members of the present invention.

In U.S. Pat. No. 4,921,769, the disclosure of which is totally incorporated herein by reference, there are illustrated photoconductive imaging members with blocking layers of certain polyurethanes. In embodiments, the present invention selects as the blocking layer a crosslinked polymer wherein the BCFM segments of the U.S. Pat. No. 4,921,769 patent are covalently attached to the polymer. Advantages of the hole blocking layer of the present invention over that of the '769 patent include excellent resistance to solvent degradation, superior electron transport, excellent synthetic accessibility preparation of the precursor polymer and ease of fabrication of the blocking layers.

SUMMARY OF THE INVENTION

It is a feature of the present invention to provide imaging members thereof with many of the advantages illustrated herein, such as rapid curing during the device or photoconductive member fabrication, for example, of about equal to, or less than about one minute, for example from about 5 to about 60 seconds, of the hole blocking layer, and which layer prevents, or minimizes dark injection, and wherein the resulting photoconducting members possess, for example, excellent photoinduced discharge curve characteristics, cyclic and environmental stability, and acceptable charge deficient spot levels arising from dark injection of charge carriers.

Another feature of the present invention relates to the provision of layered photoresponsive imaging members which are responsive to near infrared radiation exposure.

It is yet another feature of the present invention to provide improved layered photoresponsive imaging members with a sensitivity to visible light, and which members possess improved coating characteristics and wherein the charge transport molecules do not diffuse, or there is minimum diffusion thereof into the photogenerating layer.

Moreover, another feature of the present invention relates to the provision of layered photoresponsive imaging members with robust solvent resistant hole blocking layers.

In a further feature of the present invention there are provided imaging members containing crosslinked hole blocking polymer layers and photogenerating pigments of, for example, Type V hydroxygallium phthalocyanine.

Aspects of the present invention relate to a photoconductive imaging member comprised of a supporting substrate, a hole blocking layer thereover, a photogenerating layer and a charge transport layer, and wherein the hole blocking layer is comprised of a crosslinked polymer derived from the reaction of polymer (I) and an organosilane represented by Formula (II). The hole blocking layer polymer of the present invention can be schematically represented by (III), which is derived from the crosslinking reaction as described in Scheme 1

Scheme 1

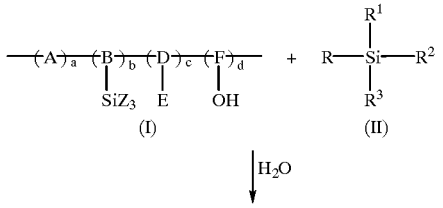

-continued

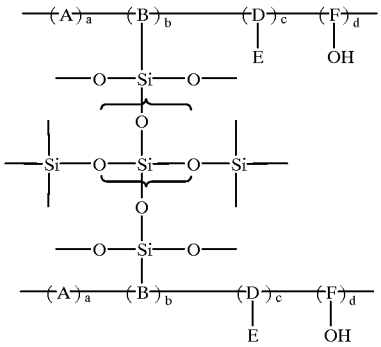

(III)

wherein E is an electron transport moiety; A, B, D and F represent the segments of the polymer backbone containing appropriate divalent linkages, which connect or bond the silyl function ($SiZ_3$), the electron transport moiety (E), and the hydroxy function (OH) to the polymer backbone; Z is selected from the group consisting of chloride, bromide, iodide, cyano, alkoxy, for example, of from about 1 to about 5 carbon atoms, acyloxy of, for example, from about 2 to about 6 carbon atoms, aryloxy of, for example, from about 6 to about 10 carbon atoms; a, b, c, and d are mole fractions of the repeating monomer units wherein a+b+c+d is equal to about 1; R is alkyl, substituted alkyl, aryl, or substituted aryl, with the substituent being halogen, alkoxy, aryloxy, amino, and the like; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halogen; a photoconductive imaging member wherein a is from about 0 to about 0.95, b is from about 0.001 to about 0.50, c is from about 0 to about 0.50, and d is from about 0.01 to about 0.95; a photoconductive imaging member wherein A is selected from the group of divalent linkages, such as alkylene, arylene, alkoxycarbonylalkylene, alkoxycarbonylarylene, and the like; B, D and F are independently selected from the group consisting of, for example,

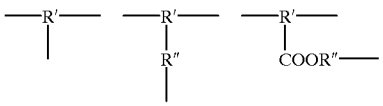

wherein R' and R" are independently trivalent linkages or divalent linkages of from about 2 to about 24 carbon atoms.

Specific illustrative examples of A are

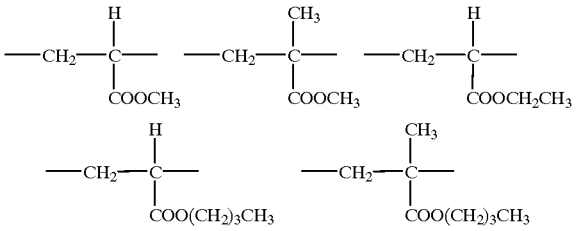

-continued

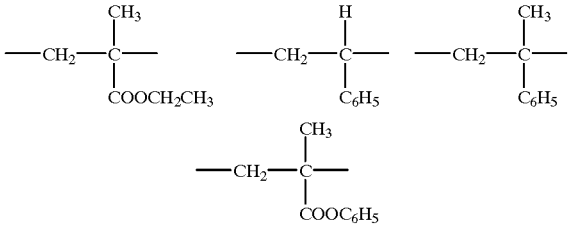

Specific illustrative examples of B, D and F are

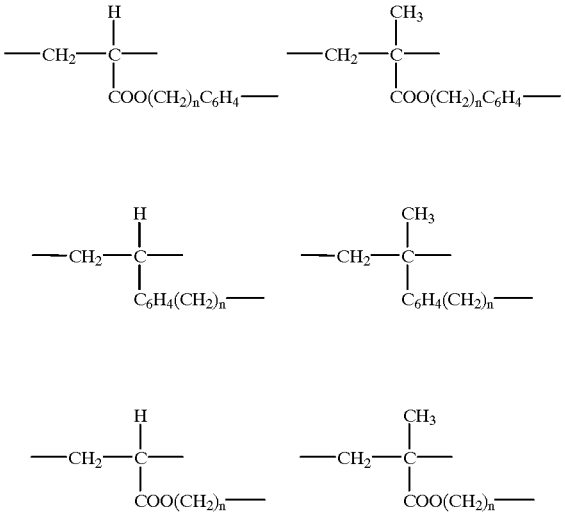

wherein n represents the number of segments and is, for example, a number of from about 1 to about 6.

Specific illustrative examples of E are

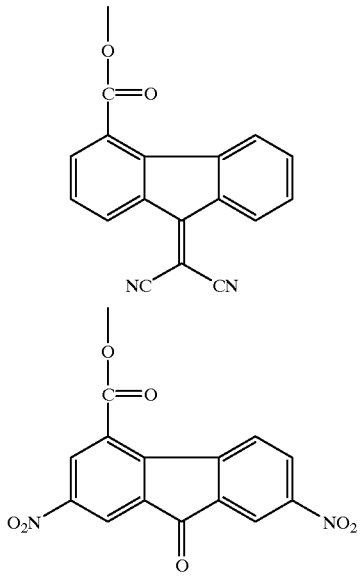

-continued

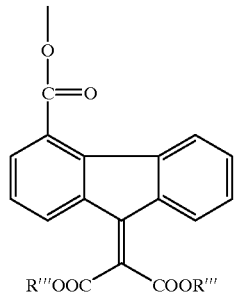

wherein R''' is alkyl of, for example, from 1 to about 10 carbon atoms.

Preferably, the hole blocking polymers of the imaging members of the present invention are derived from the crosslinking of the silylfunctionalized polymer as illustrated by Formula (IV) and the organosilane illustrated herein (II)

(IV)

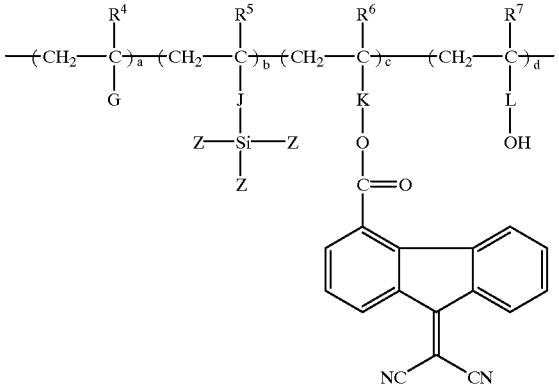

wherein organosilane (II) is selected from the group consisting of methyltrichlorosilane, dimethyldichlorosilane, methyltrimethoxysilane, methyltriethoxysilane, ethyltrichlorosilane, ethyltrimethoxysilane, dimethyidimethoxysilane, methyltriethoxysilane, ethyltriethoxysilane, propyltrimethoxysilane, 3-aminopropyltrimethoxysilane, and 3-aminopropyl triethoxysilane; and wherein the $M_n$ of (IV) is, for example, from about 1,000 to about 50,000, and wherein the $M_w$ is, for example, from about 10,000 to about 100,000; $R^4$, $R^5$, $R^6$, and $R^7$ are hydrogen and alkyl; Z is selected from the group consisting of chloride, bromide, iodide, cyano, alkoxy of about 1 to about 10 carbon atoms, and acyloxy of about 2 to about 10 carbon atoms; J is a divalent linkage preferably selected from the group consisting of alkyleneoxycarbonyl of about 2 to about 10 carbon atoms, arylene of about 6 to about 15 carbon atoms, alkylenearyl of about 7 to about 15 carbon atoms, aryleneoxycarbonyl of about 7 to about 15 carbon atoms, and alkylenearyloxycarbonyl of about 8 to about 25 carbon atoms; K is a divalent linkage preferably selected from the group consisting of arylene of about 6 to about 15 carbon atoms, alkylarylene of about 7 to about 15 carbon atoms, alkyleneoxycarbonyl of about 2 to about 10 carbon atoms, aryleneoxycarbonyl of about 7 to about 20 carbon atoms, and the like; L is preferably selected from the group consisting of arylene of about 6 to about 15 carbon atoms, alkylenearylene of about 7 to about 15 carbon atoms, alkyleneoxycarbonyl of about 2 to about 10 carbon atoms, and the like; G is preferably selected from the group consisting of halide, such as bromide or chloride, cyano, aryl of about 6 to about 15 carbon atoms, alkoxycarbonyl of about 2 to about 15 carbon atoms, or aryloxycarbonyl of about 7 to about 15 carbon atoms; a, b, c, and d represent the mole fractions of the repeating units of the polymer, and wherein a ranges from about 0 to about 0.95, b ranges from about 0.001 to about 0.50, c ranges from about 0 to about 0.50, d ranges from about 0.01 to about 0.95, and wherein the sum of a+b+c+d is equal to 1; a photoconductive imaging member wherein G is alkoxycarbonyl of from about 2 to about 10 carbon atoms, Z is alkoxy of from about 1 to about 5 carbon atoms, and K is alkylenearyl of from about 7 to about 15 carbon atoms; a photoconductive imaging member wherein G is methoxycarbonyl, Z is an alkoxy such as methoxy or ethoxy, K is methylenephenylene, and L is arylene of about 6 to about 15 carbon atoms, arylenealkyl of about 7 to about 15 carbon atoms, alkyleneoxycarbonyl of about 2 to about 10 carbon atoms, and the like; a photoconductive imaging member wherein the hole blocking layer is of a thickness of about 0.001 to about 5 microns; a photoconductive imaging member wherein the hole blocking layer is of a thickness of about 0.1 to about 5 microns; a photoconductive imaging member wherein the blocking polymer is derived from polymer (IV) preferably selected from the group consisting of polymers of the Formulas (IV-a) through (IV-h) illustrated herein; a photoconductive imaging member wherein the organosilane (II) is selected from the group consisting of alkylhalosilanes, alkylalkoxysilanes, aminoalkylsilanes, and the like, such as methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, 3-aminopropyltriethoxysilane, and the like; a photoconductive imaging member wherein organosilane (II) is 3-aminopropyltrimethoxysilane or 3-aminopropyltriethoxysilane; a photoconductive imaging member comprised in the following sequence of a supporting substrate, the crosslinked hole blocking polymer layer, of the formulas illustrated herein, an adhesive layer, a photogenerating layer and a charge transport layer; a photoconductive imaging member wherein the adhesive layer is comprised of a polyester with an $M_w$ of from about 20,000 to about 100,000, and preferably about 35,000, and an $M_n$ of from about 10,000 to 50,000 preferably about 14,000; a photoconductive imaging member wherein the supporting substrate is comprised of a conductive metal substrate; a photoconductive imaging member wherein the conductive substrate is aluminum, aluminized or titanized polyethylene terephthalate belt (MYLAR®); a photoconductive imaging member wherein said photogenerator layer is of a thickness of from about 0.05 to about 10 microns; a photoconductive imaging member wherein the transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the aryl amines are of the formula

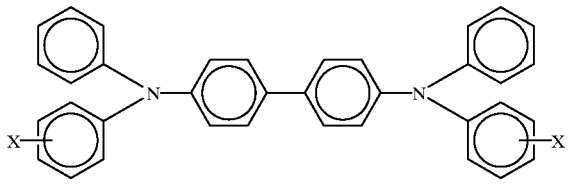

wherein X is selected from the group consisting of alkyl and halogen, and wherein the aryl amine is dispersed in a highly insulating and transparent resinous binder; a photoconductive imaging member wherein the arylamine alkyl contains from about 1 to about 10 carbon atoms; a photoconductive imaging member wherein the arylamine alkyl contains from 1 to about 5 carbon atoms; a photoconductive imaging member wherein the arylamine alkyl is methyl, wherein halogen is chlorine, and wherein the resinous binder is selected from the group consisting of polycarbonates and polystyrenes; a photoconductive imaging member wherein the aryl amine is N,N'-diphenyl-N,N-bis(3-methylphenyl)-1,1'-biphenyl-4,4'-diamine; a photoconductive imaging member further including an adhesive layer of a polyester with an $M_w$ of preferably about 70,000, and an $M_n$ of from about 25,000 to about 50,000, and preferably about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member, developing the latent image, and transferring the developed electrostatic image to a suitable substrate; a photoconductive imaging member wherein the blocking layer is derived from the crosslinking of polymer (IV) and organosilane (II) in the presence of a catalyst selected from the group consisting of carboxylic acids and amines; a photoconductive imaging member wherein acetic acid or an alkylamine is selected as the catalyst; an imaging member wherein a crosslinked siloxane polymer is selected as a hole blocking layer, and is generated from the reaction of polymer (IV) and organosilane (II); imaging members comprised of a supporting substrate, a crosslinked siloxane polymer blocking layer, thereover, a photogenerating layer of, for example, hydroxygallium phthalocyanine, and a charge transport layer.

In embodiments, the present invention relates to a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxy alkyl polymer of Formula (I) with an organosilane of Formula (II) and preferably water (I)

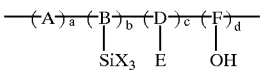

(II)

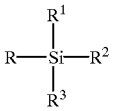

wherein A, B, D, and F represent the segments of the polymer backbone; E is an electron transporting moiety; X is selected from the group consisting of halide like chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; a photoconductive member wherein the silyl-functionalized hydroxyalkyl polymer is represented by Formula (IV)

(IV)

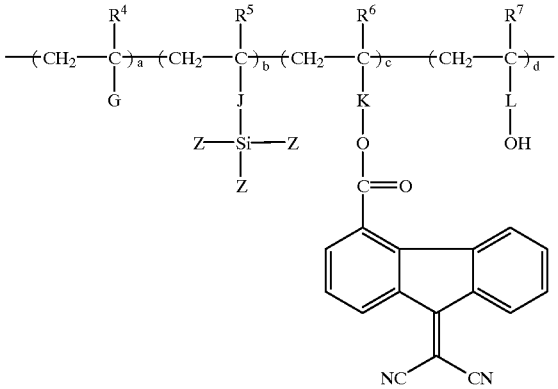

wherein $R^4$, $R^5$, $R^6$, and $R^7$ are independently selected from a hydrogen atom and alkyl; Z is selected from the group consisting of chloride, bromide, iodide, cyano, alkoxy, acyloxy; J, K and L are divalent linkages; G is aryl or alkoxycarbonyl; and a, b, c, and d are mole fractions of the repeating units of the polymer such that the sum of a+b+c+d is equal to 1; an imaging member wherein the hole blocking layer is comprised of crosslinked polymer schematically represented by structure (V) derived from the reaction of (IV) and organosilane (II)

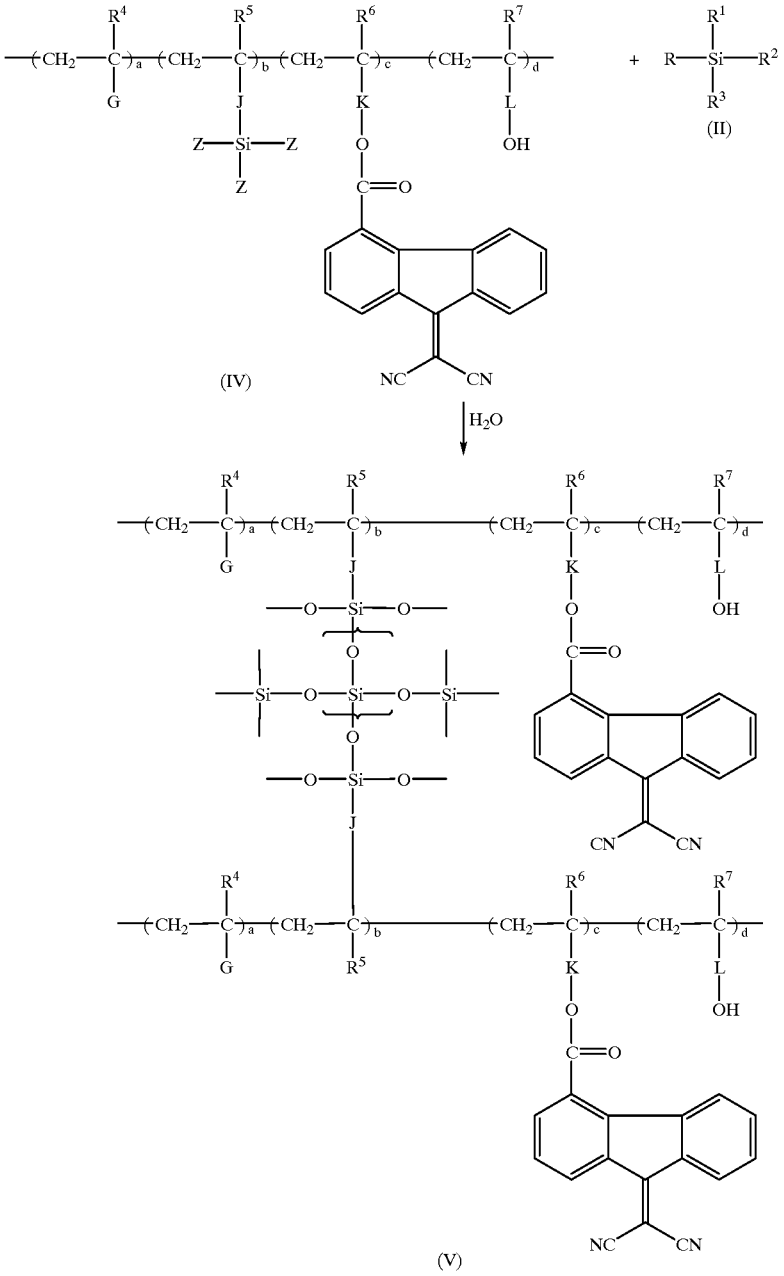

wherein $R^4$, $R^5$, $R^6$, and $R^7$ are hydrogen and alkyl; Z is selected from the group consisting of chloride, bromide, iodide, cyano, alkoxy, and acyloxy; J is a divalent linkage selected from the group consisting of alkyleneoxycarbonyl, arylene, alkylenearyl, aryleneoxycarbonyl, and alkylenearyloxycarbonyl; K is divalent linkage selected from the group consisting of arylene, alkylarylene, alkyleneoxycarbonyl, aryleneoxycarbonyl; L is selected from the group consisting of arylene, alkylenearylene, and alkyleneoxycarbonyl; G is selected from the group consisting of bromide, chloride, iodide, cyano, aryl, alkoxycarbonyl, and aryloxycarbonyl; a, b, c, and d are the mole fractions of the repeating units of the polymer, such that the sum of a+b+c+d is equal to 1; and R is alkyl, substituted alkyl, aryl, or substituted aryl, with the substituent being halogen, alkoxy, aryloxy, or amino; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide; a photoconductive imaging member wherein organosilane (II) is selected from the group consisting of methyltrichlorosilane, dimethyidichlorosilane, methyltrimethoxysilane, methyltriethoxysi lane, ethyltrichlorosilane, ethyltrimethoxysilane, dimethyidimethoxysilane, methyltriethoxysilane, ethyltriethoxysilane, propyltrimethoxysilane, 3-aminopropyltrimethoxysilane, and 3-aminopropyltriethoxysilane; a crosslinked polymer of Formula (III)

(III)

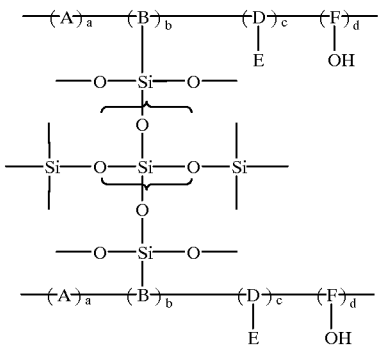

wherein E is an electron transport moiety; A, B, D and F represent segments of the polymer backbone; and a, b, c, and d represent mole fractions of the repeating units wherein the sum of a+b+c+d is equal to about 1; a photoconductive imaging member comprised of a hole blocking layer, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II)

(I)

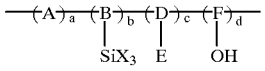

(II)

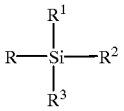

wherein A, B, D, and F represent the segments of the polymer backbone; E is an electron transporting moiety; X is cyano, alkyl, alkoxy, halide, aryl, aryloxy, or acyloxy; a, b, c, and d are mole fractions of the repeating monomers; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; and a photoconductive imaging member comprised in sequence of a supporting substrate, a hole blocking layer, a photogenerating layer and a charge transport layer, and wherein the hole blocking layer is comprised of a polymer generated from the reaction of a silyl-functionalized hydroxyalkyl polymer of Formula (I) with an organosilane of Formula (II)

(I)

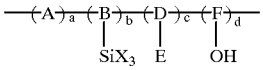

(II)

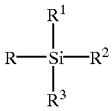

wherein A, B, D, and F represent the segments of the polymer backbone; E is an electron transporting moiety; X is halide, aliphatic, aryl, or cyano; a, b, c, and d represent mole fractions of the repeating monomer units; R is aliphatic or aryl, and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Of importance with respect to the present invention in embodiments thereof is the hole blocking layer preferably comprised of a crosslinked siloxane polymer as schematically represented by Formula (V) derived from the reaction of polymer (IV) and organosilane (II) according to Scheme 2.

Scheme 2

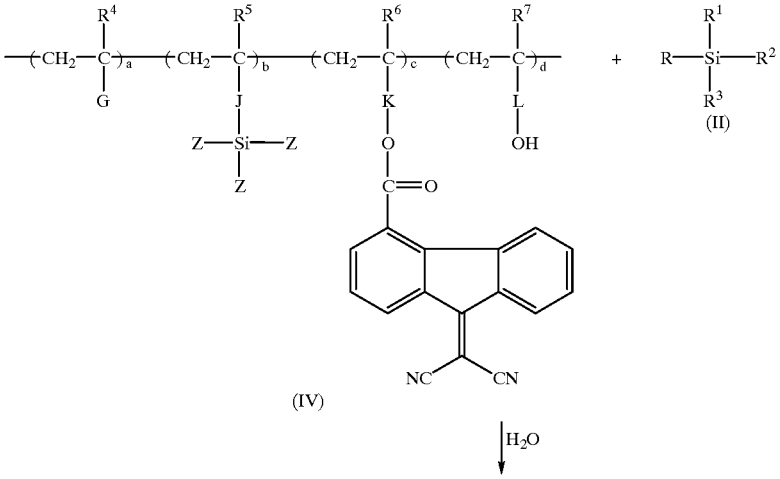

-continued

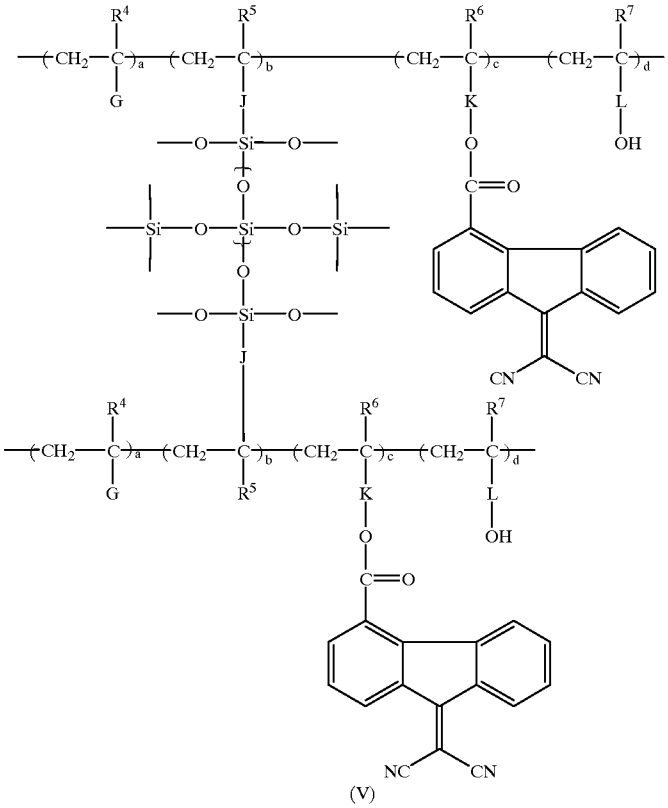

(V)

wherein the substituents, such as 2, are as illustrated herein, and $R^1$ to $R^7$ are as illustrated herein for $R^1$, $R^2$ and $R^3$, such as alkyl, aryl, alkoxy, aryloxy, halide and the like.

Illustrative examples of J are alkyleneoxycarbonyl (—R'—O—CO—) of about 2 to about 10 carbon atoms, arylene (—Ar—) of about 6 to about 15 carbon atoms, alkylenearyl (—R'—Ar—) of about 7 to about 15 carbon atoms, aryleneoxycarbonyl (—Ar—O—CO—) of about 7 to about 15 carbon atoms, and alkylenearyloxycarbonyl (—R'—Ar—O—CO—) of about 8 to about 25 carbon atoms; illustrative examples of K are arylene (—Ar—) of about 6 to about 15 carbon atoms, alkylenearyl (—R'—Ar—) of about 7 to about 15 carbon atoms, alkyleneoxycarbonyl (—R'—O—CO—) of about 2 to about 10 carbon atoms; and illustrative examples of L are arylene (—Ar—) of about 6 to about 15 carbon atoms, alkylenearyl (—R'—Ar—) of about 7 to about 15 carbon atoms, and alkyleneoxycarbonyl (—R'—O—CO—) of about 2 to about 10 carbon atoms; and wherein R is alkyl, substituted alkyl, aryl, or substituted aryl, with the substituent being halogen, alkoxy, aryloxy, amino, and the like; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide.

Illustrative examples of the organosilane (II) that can be selected for the preparation of the blocking layer of the present invention are alkyl silanes, alkoxysilanes, and aminosilanes, such as methyltrichlorosilane, dimethyidichlorosilane, methyltrimethoxysilane, methyltriethoxysilane, ethyltrichlorosilane, ethyltrimethoxysilane, dimethyidimethoxysilane, methyltriethoxysilane, ethyltriethoxysilane, propyltrimethoxysilane, 3-aminopropyltrimethoxysilane, 3-aminopropyltriethoxysilane, and the like.

Preferably in embodiments of the present invention, polymers (IV) that are utilized in the preparation of the hole blocking layer are selected from the group consisting of polymers (IV-a) through (IV-h) wherein the letters, such as a, b, c, and d are as illustrated herein (IV-a)

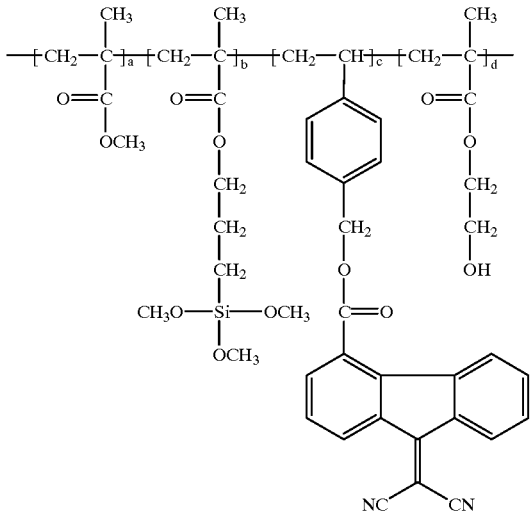

-continued
(IV-b)
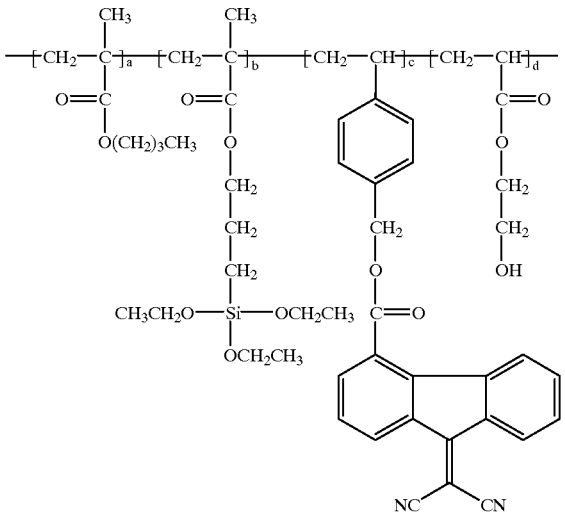
-continued
(IV-d)
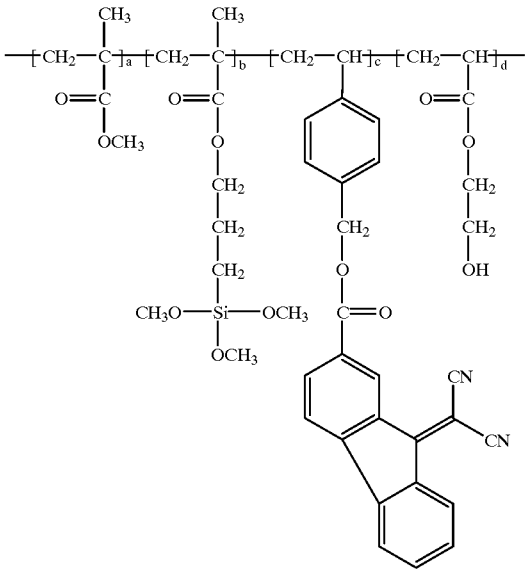
(IV-c)
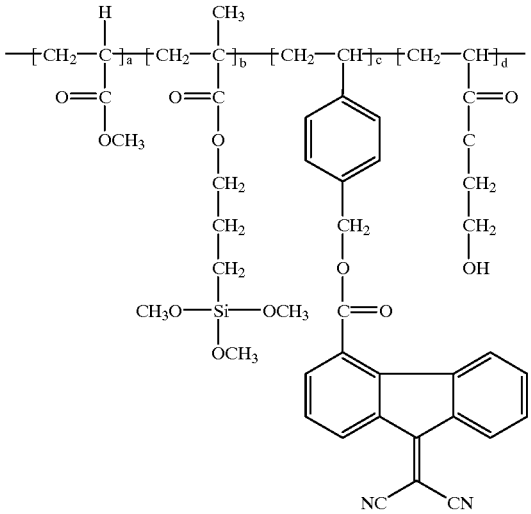
(IV-e)
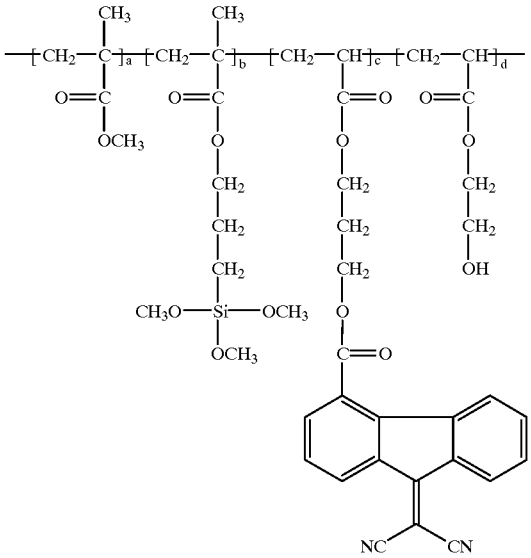

-continued (IV-f)

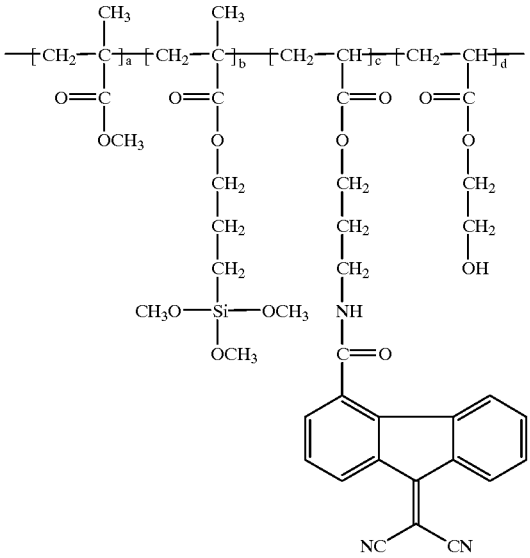

-continued (IV-h)

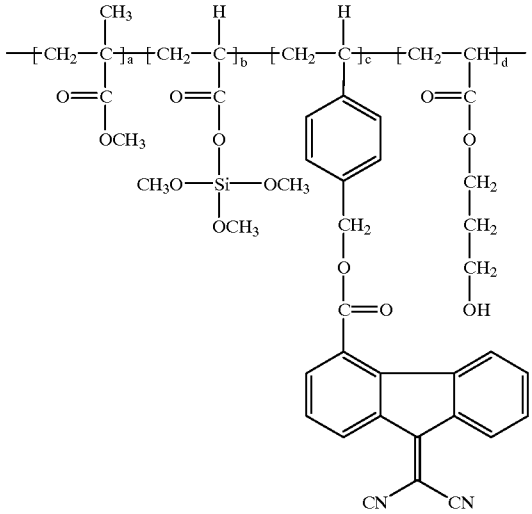

(IV-g)

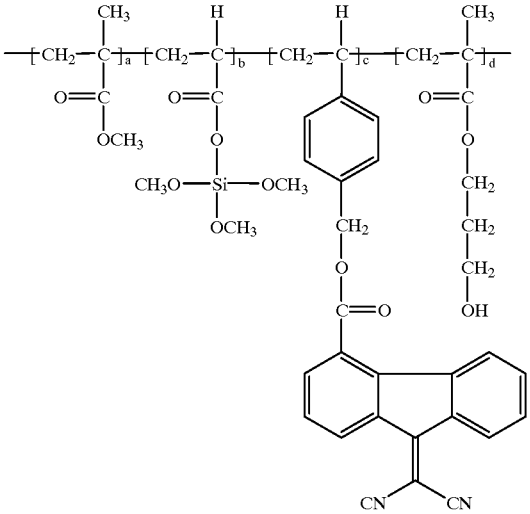

Polymer (IV) of the present invention can be prepared, for example, by free radical polymerization according to Scheme 3. Specifically, this polymer can be prepared by polymerization of a mixture of vinyl monomers (VI), (VII), (VIII) and (IX) in the presence of a suitable radical initiator, such as benzoyl peroxide, 2,2'-azobis(2-methylpropanenitrile), and the like. The polymerization is generally accomplished in an inert solvent, such as toluene, benzene, tetrahydrofuran, chloroform, or the like, at a temperature of between about 30° C. to about 120° C. A specific preparative procedure for the preparation of polymer (IV) follows. A mixture of monomers (VI), (VII), (VIII), and (IX) in effective molar equivalent amounts and a solvent, such as toluene or tetrahydrofuran, are first charged to a reactor. The mixture is stirred at a temperature ranging from ambient to about 70° C. for about 5 to about 30 minutes. Subsequently, an initiator, such as 2,2'-azobis(2-methylpropanenitrile), is added and the mixture is heated at about 50° C. to about 100° C. for a suitable period of time, for example from about 1 to about 24 hours to complete the polymerization. After the polymerization, the reaction mixture is diluted with a solvent, such as toluene or tetrahydrofuran, and poured into hexane to precipitate the polymer product, which product is collected by filtration and dried in vacuo to provide polymer (IV), which is characterized by gel permeation chromatography (GPC), and other relevant spectroscopic techniques such as IR and NMR spectroscopy.

Scheme 3

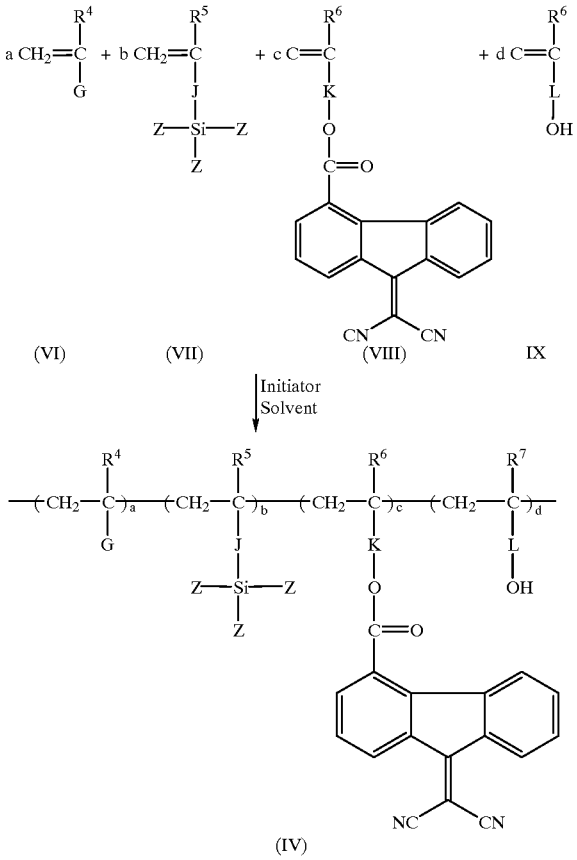

wherein the substituents and letters are as illustrated herein.

Illustrative examples of monomer (VI) selected for the preparation of polymer (IV) include acrylic and methacrylic esters such as methyl acrylate, ethyl acrylate, propyl acrylate, butyl acrylate, methyl methacrylate, ethyl methacrylate, propyl methacrytlate, butyl methacrylate, phenyl acrylate, phenyl methacrylate, and the like. Illustrative examples of monomer (VII) include 3-acryloxypropyltrimethoxysilane, 3-methacyloxypropyltrimethoxysilane, 3-acryloxypropyltriethoxysilane, 3-methacyloxypropyltriethoxysilane, 3-acryloxyethyltrimethoxysilane, 3-methacyloxyethyltrimethoxysilane, 3-methacryloxypropyl-dimethylethoxy silane, allyltrimethoxysilane, allyltriethoxysilane, and the like, and examples of vinyl monomer (VIII) include p-vinylbenzyl 9-dicyanomethylenefluorene-4-carboxylate (1); p-isopropenylbenzyl 9-dicyanomethylenefluorene-4-carboxylate (2); p-vinylbenzyl 9-dicyano methylenefluorene-2-carboxylate (3); methacryloyloxyethyl 9-dicyano methylenefluorene-4-carboxylate (4); acryloyloxyethyl 9-dicyanomethylene fluorene-4-carboxylate (5); methacryloyloxyethyl 9-dicyanomethylene fluorene-2-carboxylate (6); acryloyloxyethyl 9-dicyanomethylenefluorene-2-carboxylate (7); methacryloyloxypropyl 9-dicyanomethylenefluorene-4-carboxylate (8); and the like. Illustrative examples of monomer (IX) include 2-hydroxyethyl methacrylate, hydroxypropyl methacrylate, 2-hydroxyethyl acrylate, hydroxypropyl acrylate, 4-hydroxybutyl acrylate, 2-allyphenol, allyl alcohol, 2-allyl-6-methoxyphenol, 4-allyl-2-methoxyphenol, 4-allyl-2,6-dimethoxyphenol, and the like; a, b, c and d represent mole equivalents of (VI), (VII), (VIII) and (IX), respectively, or mole fractions of the repeating units of polymer (IV) such that a ranges from about 0 to about 0.5, b ranges from about 0.001 to about 0.5, c ranges from about 0 to about 0.50, and d ranges from about 0.10 to 0.95 provided that a+b+c+d is equal to about 1.

(1)

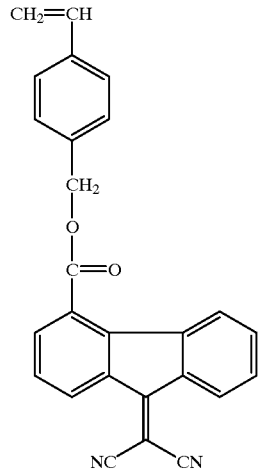

(2)

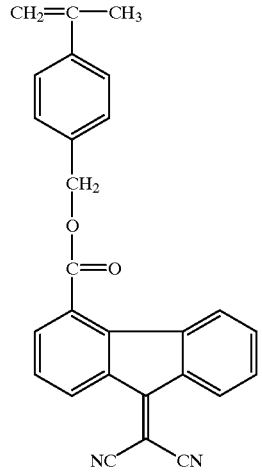

-continued
(3)
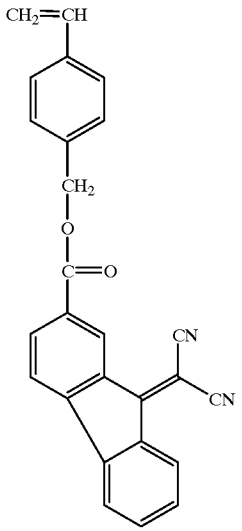
(4)
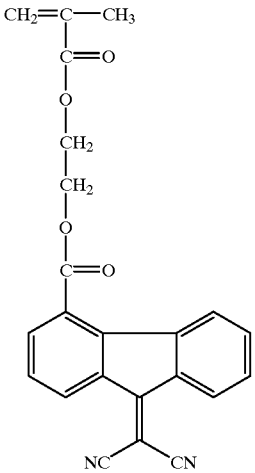
(5)
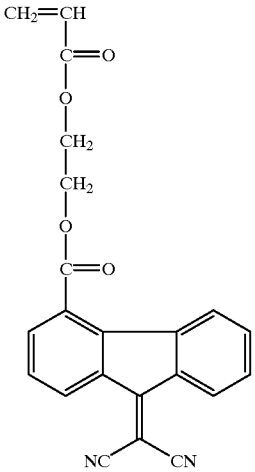
-continued
(6)
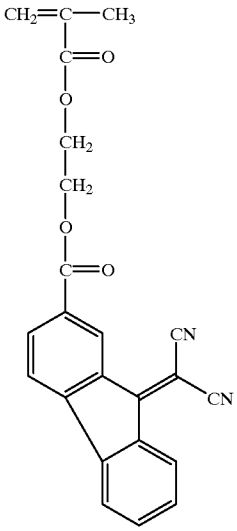
(7)
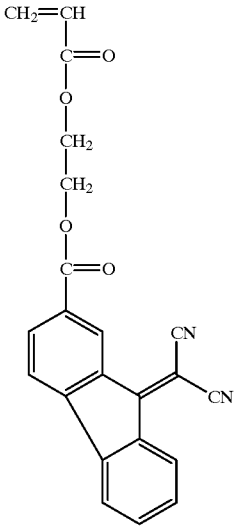
(8)
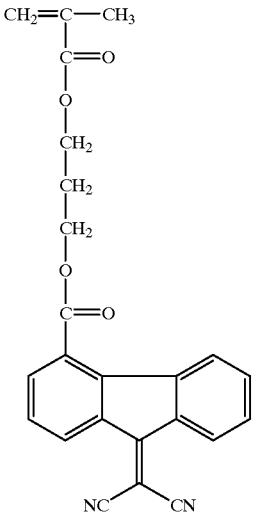

In embodiments of the present invention, the fabrication of the hole blocking layers of the present invention comprises coating a solution of polymer (IV), organosilane (II) and water in a suitable solvent onto a supporting substrate. The coated layer is then thermally dried and cured at elevated temperatures. The curing or crosslinking can generally be accomplished at, for example, about 40° C. to about 200° C., and preferably from about 80° C. to about 150° C. for a suitable time period such as from about 0.1 minute to about 2 hours. The crosslinking processes, as schematically depicted, for example, in Scheme 4, comprise the hydrolysis of the silyl groups of organosilane (II) and polymer (IV) to the hydroxysilyl functions, followed by condensation to form the siloxane (Si—O—Si) bonds. It is important that some water, for example from about 0.001 to about 10 weight percent, is present in the coating solution to effect the hydrolysis for the crosslinking reaction to occur. Trace amounts of water, such as for example about 0.01 percent by weight of solvent that are present in the coating solvents, may often be sufficient to induce the required hydrolysis reaction. Also, water may be added, particularly if the coating solvent is a water mixable, such as tetrahydrofuran, methanol, ethanol, methyl ethyl ketone. Additionally, curing or crosslinking of the coated blocking layers may also be induced to occur by humidification via exposing to a moist atmosphere prior to or during thermal treatment to effect the crosslinking reactions.

Scheme 4

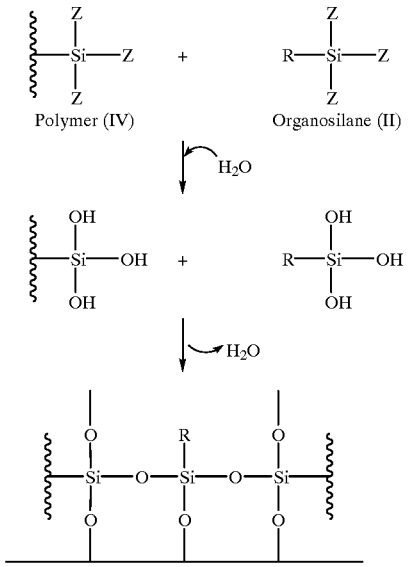

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of a minimum thickness providing there are no adverse effects on the member. In one embodiment, the thickness of this layer is from about 75 microns to about 300 microns.

The photogenerating layer, which is preferably comprised of hydroxygallium phthalocyanine Type V, is in embodiments comprised of, for example, about 50 weight percent of the Type V and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis (benzimidazo)perylene, titanyl phthalocyanines, and the like, and more specifically, vanadyl phthalocyanines, Type V hydroxygallium phthalocyanines, and inorganic components, such as selenium, especially trigonal selenium. The photogenerating pigment can be dispersed in a resin binder, similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of the layer in an embodiment is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns and preferably from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in the relevant U.S. patents recited herein, and in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesives usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the hole transporting layers, which generally are of a thickness of from about 5 microns to about 75 microns, and preferably of a thickness of from about 10 microns to about 40 microns, include molecules of the following formula

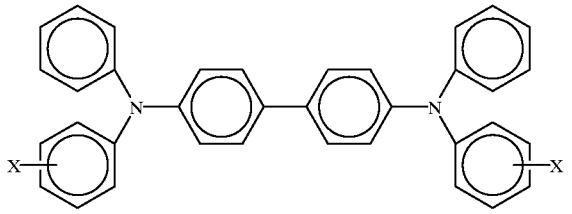

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

Specific examples of E are as illustrated herein, and for example, in U.S. Pat. No. 5,874,193, the disclosure of which is totally incorporated herein by reference.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Synthesis of Polymer (IV) with a=0.63, b=0.02, c=0.05, and d=0.30

To a 1 liter round bottomed flask were added 60 grams of 9-dicyanomethylenefluorene-4-carboxylic acid, 700 milliliters of N,N-dimethylformamide, 67.1 grams of 4-vinylbenzyl chloride, and 37 grams of sodium bicarbonate, and the resulting mixture was stirred at 40° C. for 48 hours. The mixture was poured into 1,500 milliliters of distilled water with vigorous stirring, and the resulting aqueous mixture was extracted with 1,000 milliliters of dichloromethane. The organic layer was separated and was further washed with 1,500 milliliters of distilled water and dried over anhydrous magnesium sulfate. Subsequently, the organic solvent was removed by means of a rotary evaporator and the residue was recrystallized from a mixture of dichloromethane and methanol (2:1 by volume) to provide vinylbenzyl 9-dicyanomethylenefluorene-4-carboxylate after filtration and drying in vacuo for 48 hours.

$^1$H-NMR ($CDCl_3$): δ 5.30 (d, J=10.5 Hz, 1H), 5.43 (s, 2H), 5.79 (d, J=17.5 Hz, 1H), 6.73 (d, J=10.5 Hz, 2H), 7.31~7.48 (m, overlapping with a singlet at 7.45, 7H), 7.88 (d, J=7.9 Hz, 1H), 8.07 (d, 7.9 Hz, 1H), 8.45 (d, J=7.8 Hz, 1H), 8.59 (d, J=7.9 Hz, 1 H).

IR (KBr): 2,224 (CN), 1,735 (C═O) $cm^{-1}$.

To a 1 liter three-neck round-bottomed flask, under a nitrogen blanket, were added 4.85 grams of vinylbenzyl 9-dicyanomethylene fluorene-4-carboxylate as obtained above, 15.77 grams of methyl methacrylate, 1.24 grams of 3-(trimethoxysilyl) propyl methacrylate, 9.76 grams of 2-hydroxyethyl methacrylate, and 200 milliliters of tetrahydrofuran. The resulting mixture was stirred at about 50° C. for 10 minutes, followed by the addition of 0.33 gram of 2,2'-azobis(isobutyronitrile) initiator. The mixture was subsequently stirred and refluxed for 24 hours. The resulting polymer solution was diluted with 600 milliliters of tetrahydrofuran at room temperature, about 25° C. throughout, and was then poured into 5,000 milliliters of hexane with stirring to precipitate the above polymer (IV) product. The solid product, polymer (IV-a), was collected by filtration and dried at room temperature in vacuo for 24 hours to give 25 grams (82 percent) of polymer (III-a). The polymer displayed an $M_w$ of 43,426 and $M_n$, of 17,822 as measured by GPC and IR (film) absorption of 2,223 (CN), 1,736 (C═O) $cm^{-1}$, and 3,467(OH).

EXAMPLE II

Synthesis of Polymer (VI) with a=68, b=0.02, c=0, and d=0.30

This polymer was prepared in accordance with the procedure of Example II except that 20.42 grams of methyl methacrylate, 1.49 grams of 3-(trimethoxysilyl) propyl methacrylate, 11.71 grams of 2-hydroxyethyl methacrylate, 240 milliliters of tetrahydrofuran, and 0.394 gram of 2,2'-azobis(isobutyronitrile) initiator were utilized. The yield was 30 grams (89.2 percent).

The polymer displayed an $M_w$ of 29,762 and $M_n$ of 12,537 as measured by GPC and IR (film) absorption of 1,736 (C═O) $cm^{-1}$ and 3,467 $cm^{-1}$ (OH).

EXAMPLE III

Synthesis of Polymer (IV) with a=48, b=0.02, c=0, and d=0.50

This polymer was prepared in accordance with the procedure of Example II except that 24.03 grams of methyl methacrylate, 2.48 grams of 3-(trimethoxysilyl) propyl methacrylate, 32.54 grams of 2-hydroxyethyl methacrylate, 385 milliliters of tetrahydrofuran, and 0.63 gram of 2,2'-azobis(isobutyronitrile) initiator were utilized. The yield was 55 grams (93.1 percent).

The polymer displayed an $M_w$ of 33,358 and $M_n$ of 13,138 as measured by GPC and IR (film) absorption of 1,735 (C═O) $cm^{-1}$ and 3,468 $cm^{-1}$ (OH).

EXAMPLE IV

An illustrative photoresponsive imaging device incorporating the blocking layer of the present invention was fabricated as follows.

On a 75 micron thick titanized MYLAR® substrate was coated by draw bar technique a hole blocking layer from a solution of 0.48 gram of polymer (IV) of Example II and 0.32 gram of 3-aminopropyltrimethoxysilane in 9.2 grams of a 86.1/10.4/3.5 (by weight percent) mixture of tetrahydrofuran/ethanol/water. After drying at 135° C. for 15 minutes, a blocking layer (HBL) encompassed by Formula (III) of a thickness of about 0.5 to 0.7 micron was obtained. Overcoated on the top of the blocking layer was a 0.05 micron thick adhesive layer prepared from a solution of 2 weight percent of a DuPont 49K (49,000) polyester in dichloromethane. A 0.2 micron photogenerating layer was subsequently coated on top of the adhesive layer from a dispersion of hydroxy gallium phthalocyanine Type V is (0.46 gram) and a polystyrene-b-polyvinylpyridine block copolymer binder (0.48 gram) in 20 grams of toluene, followed by drying at 100° C. for 10 minutes. Subsequently, a 25 micron charge transport layer (CTL) was coated on top of the photogenerating layer from a solution of N,N'-diphenyl-N,N-bis(3-methyl phenyl)-1,1'-biphenyl-4,4'-diamine (2.64 grams) and a polycarbonate (3.5 grams) in 40 grams of dichloromethane.

A control device was also prepared in a similar manner without a blocking layer.

The xerographic electrical properties of the imaging members can be determined by known means including, as indicated herein, electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

The following table summarizes the electrical performance of these devices, which, for example, illustrate the effective blockage of charge injection by the hole blocking layer (HBL) of the present invention. Specifically, while the dark development potential (Vddp), the half discharge exposure energy ($E_{1/2}$), and the residual voltage are similar for the control device and the device of the present invention, the dark decay, which measures the dark conductivity related to hole injection into the photogenerator layer of the device of the present invention is significantly lower than that of the control device.

| Device # | CTL (μm) | Vddp (V) | $E_{1/2}$ ergs/$cm^2$ | Dark Decay V @ 500 ms) | Vr (V) |
|---|---|---|---|---|---|
| Control Device Without HBL | 25.0 | 813 | 1.54 | 19.5 | 0–4 |
| Device with 0.5–0.7 μm Crosslinked Siloxane HBL | 23.2 | 801 | 1.48 | 5.3 | 0–4 |

EXAMPLE V

Another photoresponsive imaging device with a hole blocking layer of the present invention was fabricated in accordance with the procedure of Example IV except that the HBL thickness was increased to about 1.5 to about 2 microns instead of 0.7 micron. The blocking layer was prepared from a solution of 0.48 gram of polymer (IV) of Example II and 0.32 gram of 3-aminopropyltrimethoxysilane in 9.2 grams of a 86.1/10.4/3.5 (by weight percent) mixture of tetrahydrofuran/ethanol/water. After drying at 135° C. for 15 minutes, a blocking layer (HBL) encompassed by Formula VII of a thickness of about 1.5 to about 2 microns was obtained. The following table summarizes the electrical performance of this device and the control device or member.

| Device # | CTL (μm) | Vddp (V) | $E_{1/2}$ ergs/$cm^2$ | Dark Decay V @ 500 ms) | Vr (V) |
|---|---|---|---|---|---|
| Control Device without HBL | 25.0 | 813 | 1.54 | 19.5 | 0–4 |

-continued

| Device # | CTL (μm) | Vddp (V) | $E_{1/2}$ ergs/cm$^2$ | Dark Decay V @ 500 ms) | Vr (V) |
|---|---|---|---|---|---|
| Device with 1.5–2.0 μm Crosslinked Siloxane HBL | 24.0 | 804 | 1.54 | 7.8 | 0–6 |

EXAMPLE VI

A photoresponsive imaging device with a hole blocking layer derived from polymer (IV) of Example III was prepared in accordance to the procedure of Example V. The HBL thickness was about 1.3 to about 1.7 micron, and was prepared from a solution of 0.9 gram of polymer (III-a) of Example III and 0.6 gram of 3-aminopropyltrimethoxysilane in 8.5 grams of a mixture 60/36, 5/3.5 (by weight percent) of tetrahydrofuran/ethanol/water. After drying at 140° C. for 1 minute, a blocking layer (HBL) encompassed by Formula VII of a thickness of about 1.3 to about 1.7 microns was obtained.

The following table summarizes the electrical performance of this device, and the control device or imaging member.

| Device # | CTL (μm) | Vddp (V) | $E_{1/2}$ ergs/cm$^2$ | Dark Decay V @ 500 ms) | Vr (V) |
|---|---|---|---|---|---|
| Control Device without HBL | 25.0 | 813 | 1.54 | 19.5 | 0–4 |
| Device with 1.3–1.7 μm Crosslinked Siloxane HBL | 24.7 | 804 | 1.49 | 10.2 | 0–4 |

EXAMPLE VII

Another photoresponsive imaging device with a hole blocking layer derived from Polymer (IV) of Example III was fabricated in accordance with the procedure of Example VI except that the HBL thickness was about 3.2 to about 4.5 microns instead of about 1.3 to about 1.7 microns. After drying at 140° C. for 15 minutes, a blocking layer (HBL) encompassed by Formula VII of a thickness of about 3.2 to about 4.5 microns was obtained. The following table summarizes the electrical performance of this device, and the control device or imaging member.

| Device # | CTL (μm) | Vddp (V) | $E_{1/2}$ ergs/cm$^2$ | Dark Decay V @ 500 ms) | Vr (V) |
|---|---|---|---|---|---|
| Control Device without HBL | 25.0 | 813 | 1.54 | 19.5 | 0–4 |
| Device with 3.2–4.5 μm Crosslinked Siloxane HBL | 25.2 | 806 | 1.59 | 13.1 | 0–5 |

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water (I)

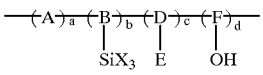

(II)

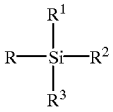

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

2. A photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water (I)

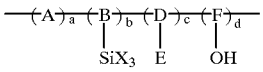

(II)

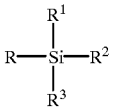

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; and wherein the silyl-functionalized hydroxyalkyl polymer is represented by Formula (IV)

(IV)

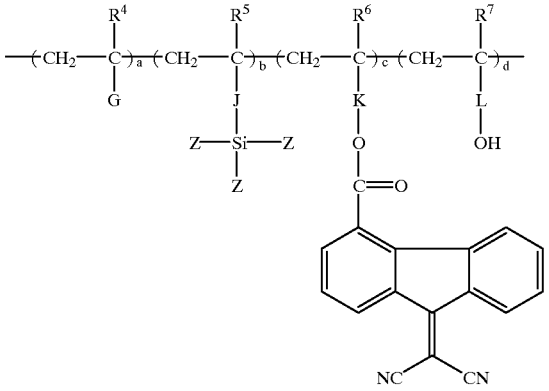

wherein $R^4$, $R^5$, $R^6$, and $R^7$ are independently selected from a hydrogen atom and alkyl; Z is selected from the group consisting of chloride, bromide, iodide, cyano, alkoxy, acyloxy; J, K and L are divalent linkages; G is aryl or alkoxycarbonyl; and a, b, c, and d are mole fractions wherein the sum of a+b+c+d is equal to 1.

3. An imaging member in accordance with claim 1 wherein said silyl-functionalized hydroxyalkyl polymer is selected from the group consisting of (IV-a) through (IV-h).

4. An imaging member in accordance with claim 1 wherein said silyl-functionalized hydroxyalkyl polymer is (IV-a), (IV-b), (IV-c) or (IV-d).

5. An imaging member in accordance with claim 1 wherein said silyl-functionalized hydroxyalkyl polymer is (IV-e), (IV-f), (IV-g), or (IV-h).

6. An imaging member in accordance with claim 1 wherein the silyl-functionalized hydroxyalkyl polymer possesses a weight average molecular weight $M_w$ of from about 10,000 to about 100,000.

7. An imaging member in accordance with claim 1 wherein the silyl-functionalized hydroxyalkyl polymer possesses an $M_w$ of from about 20,000 to about 60,000.

8. An imaging member in accordance with claim 1 wherein the silyl-functionalized hydroxyalkyl polymer possesses a number average molecular weight $M_n$ of about 1,000 to about 50,000.

9. An imaging member in accordance with claim 1 wherein the silyl-functionalized hydroxyalkyl polymer possesses an $M_n$ of from about 3,000 to about 20,000.

10. An imaging member in accordance with claim 1 wherein organosilane (II) is aminoalkyltrimethoxysilane.

11. An imaging member in accordance with claim 1 wherein organosilane (II) is aminoalkyltriethoxysilane.

12. An imaging member in accordance with claim 1 wherein organosilane (II) is 3-aminopropyltrialkoxysilane.

13. A member in accordance with claim 1 wherein organosilane (II) is 3-aminopropyltrimethoxysilane, or 3-aminopropyltriethoxysilane.

14. An imaging member in accordance with claim 1 wherein organosilane (II) is aminoalkylalkoxysilane.

15. An imaging member in accordance with claim 10 wherein alkyl contains from about 1 to about 25 carbon atoms.

16. An imaging member in accordance with claim 10 wherein alkyl contains from about 1 to about 10 carbon atoms.

17. An imaging member in accordance with claim 12 wherein alkoxy contains from about 1 to about 10 carbon atoms.

18. An imaging member in accordance with claim 1 wherein said hole blocking layer is comprised of crosslinked polymer schematically represented by (V) derived from the reaction of polymer (IV) and organosilane (II)

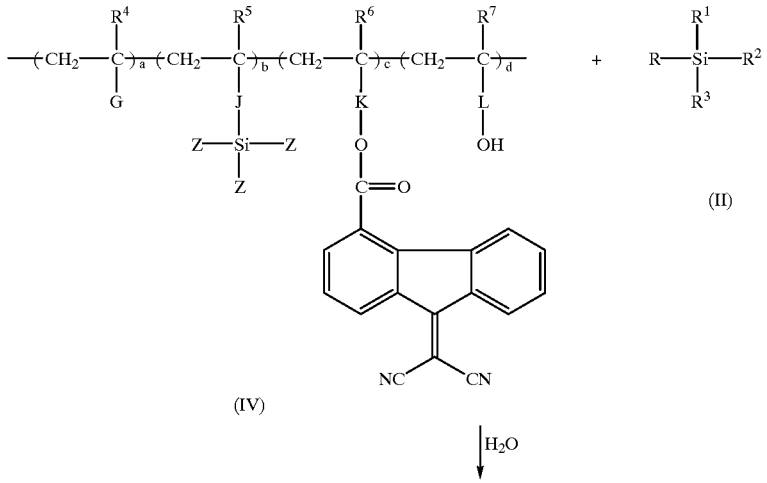

(IV) (II)

-continued

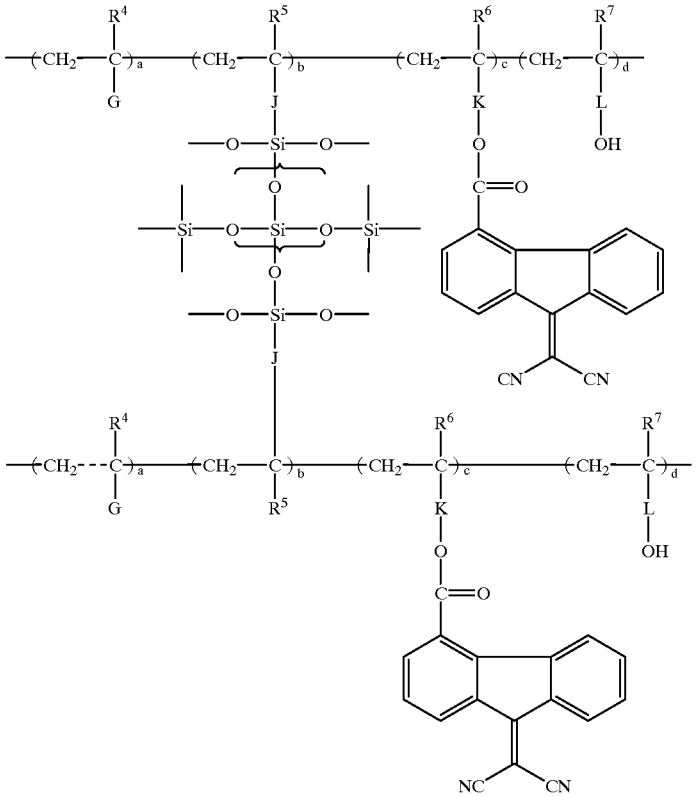

(V)

wherein $R^4$, $R^5$, $R^6$, and $R^7$ are hydrogen and alkyl; Z is selected from the group consisting of chloride, bromide, iodide, cyano, alkoxy, and acyloxy; J is a divalent linkage selected from the group consisting of alkyleneoxycarbonyl, arylene, alkylenearyl, aryleneoxycarbonyl, and alkylenearyloxycarbonyl; K is divalent linkage selected from the group consisting of arylene, alkylarylene, alkyleneoxycarbonyl, aryleneoxycarbonyl; L is selected from the group consisting of arylene, alkylenearylene, and alkyleneoxycarbonyl; G is selected from the group consisting of bromide, chloride, iodide, cyano, aryl, alkoxycarbonyl, and aryloxycarbonyl; a, b, c, and d are the mole fractions of the repeating units of the polymer, such that the sum of a+b+c+d is equal to 1; and R is alkyl, substituted alkyl, aryl, or substituted aryl, with the substituent being halogen, alkoxy, aryloxy, or amino; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide.

19. A photoconductive imaging member in accordance with claim 18 wherein a is from about 0 to about 0.95, b is from about 0.001 to about 0.50, c is from about 0 to about 0.50, d is from about 0.01 to about 0.95, and the sum of a+b+c+d is equal to 1.

20. A photoconductive imaging member in accordance with claim 18 wherein organosilane (II) is selected from the group consisting of methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, and 3-aminopropyltriethoxysilane.

21. A photoconductive imaging member in accordance with claim 18 wherein said organosilane (II) is 3-aminopropyltrimethoxysilane, or 3-aminopropyltriethoxysilane.

22. A photoconductive imaging member in accordance with claim 1 wherein said hole blocking layer is of a thickness of about 0.001 to about 5 microns.

23. A photoconductive imaging member in accordance with claim 1 wherein said hole blocking layer is of a thickness of about 0.1 to about 5 microns.

24. A photoconductive imaging member in accordance with claim 1 comprised in the following sequence of a supporting substrate, said hole blocking layer, an adhesive layer, a photogenerating layer and a charge transport layer.

25. A photoconductive imaging member in accordance with claim 24 wherein the adhesive layer is comprised of a polyester with an $M_w$ of about 70,000, and an $M_n$ of about 35,000.

26. A photoconductive imaging member in accordance with claim 1 wherein the supporting substrate is comprised of a conductive metal substrate.

27. A photoconductive imaging member in accordance with claim 26 wherein the conductive substrate is aluminum, aluminized polyethylene terephthalate or titanized polyethylene terephthalate.

28. A photoconductive imaging member in accordance with claim 1 wherein said photogenerator layer is of a thickness of from about 0.05 to about 10 microns.

29. A photoconductive imaging member in accordance with claim 1 wherein said transport layer is of a thickness of from about 10 to about 50 microns.

30. A photoconductive imaging member in accordance with claim 1 wherein the photogenerating layer is comprised of photogenerating pigments dispersed in a resinous binder in an amount of from about 5 percent by weight to about 95 percent by weight.

31. A photoconductive imaging member in accordance with claim 30 wherein the resinous binder is selected from the group consisting of polyesters, polyvinyl butyrals, polycarbonates, polystyrene-b-polyvinyl pyridine, and polyvinyl formals.

32. A photoconductive imaging member in accordance with claim 1 wherein said charge transport layer comprises aryl amine molecules.

33. A photoconductive imaging member in accordance with claim 32 wherein the aryl amine is of the formula

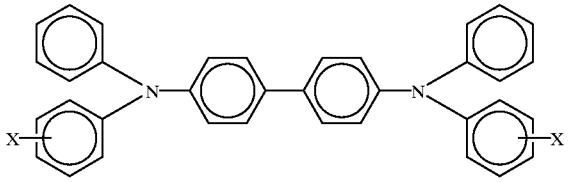

wherein X is selected from the group consisting of alkyl and halogen, and wherein the aryl amine is dispersed in a resinous binder.

34. A photoconductive imaging member in accordance with claim 33 wherein alkyl contains from about 1 to about 10 carbon atoms.

35. A photoconductive imaging member in accordance with claim 33 wherein alkyl contains from 1 to about 5 carbon atoms.

36. A photoconductive imaging member in accordance with claim 33 wherein alkyl is methyl, wherein halogen is chlorine, and wherein the resinous binder is selected from the group consisting of polycarbonates and polystyrenes.

37. A photoconductive imaging member in accordance with claim 33 wherein the aryl amine is N,N'-diphenyl-N, N-bis(3-methyl phenyl)-1,1'-biphenyl-4,4'-diamine.

38. A photoconductive imaging member in accordance with claim 1 further including an adhesive layer of a polyester with an $M_w$ of about 70,000, and an $M_n$ of about 35,000.

39. A photoconductive imaging member in accordance with claim 1 wherein the photogenerating layer is comprised of metal phthalocyanines or metal free phthalocyanines.

40. A photoconductive imaging member in accordance with claim 1 wherein the photogenerating layer is comprised of titanyl phthalocyanines, perylenes, or hydroxygallium phthalocyanines.

41. A photoconductive imaging member in accordance with claim 1 wherein the photogenerating layer is comprised of Type V hydroxygallium phthalocyanine.

42. A method of imaging which comprises generating an electrostatic latent image on the imaging member of claim 1, developing the latent image, and transferring the developed electrostatic image to a suitable substrate.

43. A photoconductive imaging member in accordance with claim 1 wherein said crosslinking is generated in the presence of a catalyst selected from the group consisting of carboxylic acids and amines.

44. A photoconductive imaging member in accordance with claim 43 wherein acetic acid or an alkylamine is selected as the catalyst.

45. A photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II)

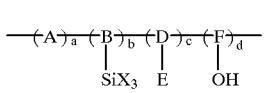

(I)

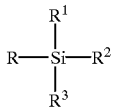

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; and wherein said hole blocking layer is comprised of crosslinked polymer schematically represented by (V) derived from the reaction of polymer (IV) and organosilane (II).

46. A photoconductive imaging member comprised of a hole blocking layer, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II)

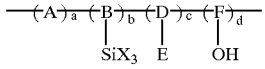

(I)

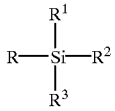

(II)

wherein A, B, D, and F represent the segments of the polymer backbone; E is an electron transporting moiety; X is cyano, alkyl, alkoxy, halide, aryl, aryloxy, or acyloxy; a, b, c, and d are mole fractions of the repeating monomer units; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

47. A photoconductive imaging member comprised of a supporting substrate, a hole blocking layer, a photogenerating layer and a charge transport layer, and wherein the hole blocking layer is comprised of a polymer generated from the reaction of a silyl-functionalized hydroxyalkyl polymer of Formula (I) with an organosilane of Formula (II)

(I)

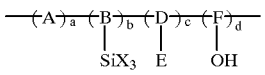

(II)

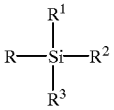

wherein A, B, D, and F represent the segments of the polymer backbone; E is an electron transporting moiety; X is halide, aliphatic, aryl, or cyano; a, b, c, and d represent mole fractions of the repeating monomer units; R is aliphatic or aryl, and $R^1$, $R^2$, and $R^3$ are independently selected from the group consisting of alkyl, aryl, alkoxy, aryloxy, acyloxy, haogen, cyano, and amino, subject to the provision that two of $R^1$, $R^2$, and $R^3$ are independently selected from the group consisting of alkoxy, aryloxy, acyloxy, and halide.

48. A photoconductive imaging member in accordance with claim 1 wherein A, B, D, and F represent the segments of the polymer backbone, and which segments are selected from the group consisting of

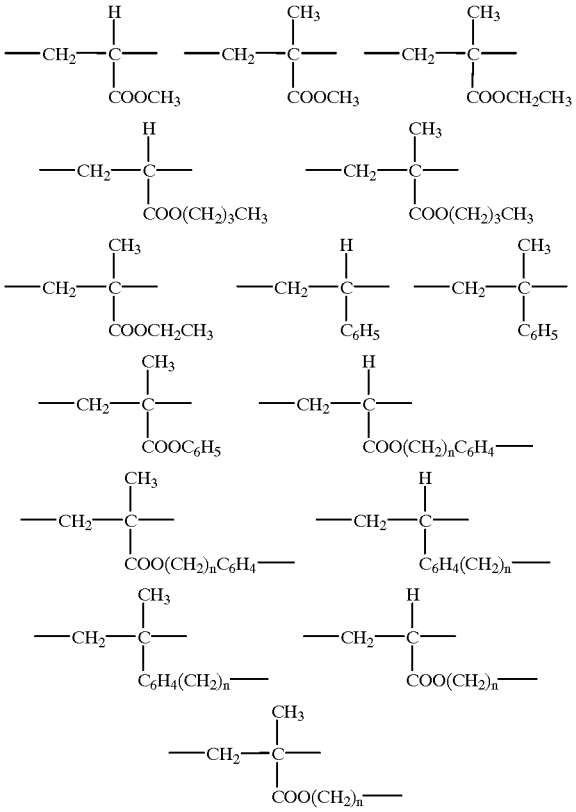

wherein n represents the number of the segments.

49. A photoconductive imaging member in accordance with claim 47 wherein A, B, D, and F represent the segments of the polymer backbone, and which segments are selected from the group consisting of

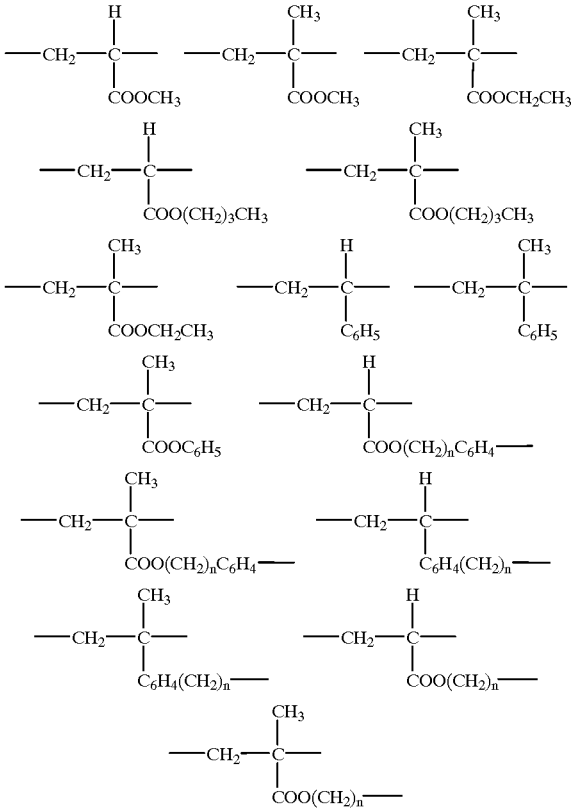

wherein n represents the number of the segments.

50. A photoconductive imaging member in accordance with claim 1 wherein R is alkyl.

51. A photoconductive imaging member in accordance with claim 1 wherein X is halide.

52. A photoconductive imaging member consisting essentially of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water (I)

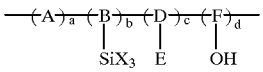

(II)

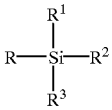

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

53. A photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water (I)

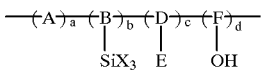

(II)

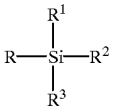

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; all equivalents thereof and all substantial or similar equivalents thereof.

* * * * *